US005361460A

United States Patent [19]

Pan

[11] Patent Number: 5,361,460

[45] Date of Patent: Nov. 8, 1994

[54] TIE CLIP MOUNTED BEHIND A TIE

[76] Inventor: Chih-Teng Pan, P.O. Box 96-405, Taipei 10098, Taiwan, Prov. of China

[21] Appl. No.: 173,617

[22] Filed: Dec. 27, 1993

[51] Int. Cl.[5] ..... A41D 25/00

[52] U.S. Cl. ..... 24/49 R; 24/49 C; 24/49 CF; 2/145

[58] Field of Search ..... 24/49 R, 49 CF, 49 C, 24/49 CC, 49 K, 49 TS, 58; 2/145

[56] References Cited

U.S. PATENT DOCUMENTS

| | | | |
|---|---|---|---|
| 862,328 | 8/1907 | Figg | 24/49 TS |
| 1,128,601 | 2/1915 | Grieve | 24/49 C |
| 1,381,846 | 6/1921 | Maker et al. | 24/49 C |
| 1,573,885 | 2/1926 | Weisbaum | 2/145 |
| 2,002,231 | 5/1935 | Baer | 2/145 |
| 2,195,594 | 4/1940 | Kreisler | 24/49 CF |
| 2,402,956 | 7/1946 | Fyfe | 24/49 CF |
| 2,994,116 | 8/1961 | Anderson | 24/49 C |

FOREIGN PATENT DOCUMENTS 0146199 7/1979 Taiwan, Prov. of China .

*Primary Examiner*—Victor N. Sakran

[57] ABSTRACT

A tie clip mounted behind a tie, which comprises a body portion having an inner plate and an outer plate arranged in parallel; one end of the two plates forms into a bent-closed end, while the other end thereof forms into a clip opening; the outer plate is bent from the clip opening to form into an inner clip arm and a resilient plate. Both ends of the inner plate are furnished with two small round holes respectively to connect with two ends of two chains, while the other ends of the two chains are sewed to the back side of a tie. The tie clip can be put to a front opening of a shirt through the clip opening; a tie and the tie clip can always be maintained in a balance and beautiful manner upon being swing as a result of user's moving.

6 Claims, 2 Drawing Sheets

TIE CLIP MOUNTED BEHIND A TIE

BACKGROUND OF THE INVENTION

1. Field of the Invention

This invention relates to a tie clip, and particularly to a tie clip to be attached on the back side of a tie by using two symmetrical chains. The tie clip is to be attached to a front opening of a shirt through a clip opening of the tie clip.

2. Description of the Prior Art

The structure of a conventional tie clip usually comprises a decorative panel, of which one end is bent back to form a closed-bent plate; one end of the closed-bent plate is connected with a clip arm through a pivot, which is mounted with a return spring. In real use, an opening formed by means of the decorative panel and the clip arm will clip the tie to a front opening of a shirt. The tie clipped to the front opening would have more or less wrinkles or folds upon the user moving; a portion of the tie between the user's neck and the clipped point might protrude out or have wrinkles upon the user sitting on a chair in a manner inclining forwards. When the user sits right vertically on a chair, the front opening of a shirt might have wrinkles, or the tie clip might become oblique or clip at a wrong position as a result of the tie being pulled by the tie clip.

Another prior art is the tie tack, which comprises a chain; one end of the chain is connected with a ring-shaped hook mounted on a button of a shirt, while the other end thereof is connected with a tack button. After the tack is put through a tie, the tack button will clamp the tack; then, the ring-shaped hook is fastened to a button of a shirt. Such a tie tack is usually limited with the position of shirt buttons. When such a tie is put on a shirt, the position of the tack would cause the ring-shaped hook to move up or down to find a right button. The chain will provide a buffer effect for the tie to swing within a given space upon a user moving; such a tack would damage a tie after repeatedly stinging through the tie.

Still another prior art has been developed for overcoming the aforesaid drawbacks, i.e., a bow-shaped frame, of which both ends are connected with two chains; the other ends of the two chains are connected with a decorative panel. The mid-point of the bow-shaped frame has a hook to be fastened to a button on a shirt. After the hook is fastened to a button, a tie can be put through a ring formed with the chains and the decorative panel so as to provide the tie with a buffer space to swing upon the user moving; in that case, the tie would not have wrinkles, and would not be pulled tight or swung too much; the aforesaid prior art is disclosed in Taiwan Patent No. 79208263; however, such a structure is unable to adapt to a shirt with a series of invisible buttons; further, as a result of the position limit of the buttons on a shirt, such tie clip is unable to fasten on any part desired of a front opening.

SUMMARY OF THE INVENTION

This invention provides a tie clip, of which the prime object is to provide a body portion made of a resilient plate to be bent into two parallel plates, i.e., an inner plate and an outer plate; one end of the two plates form into a clip opening. Both ends of the inner plate are furnished with two small round holes for connecting two chains respectively; the other ends of the two chains are attached to the back side of a tie. The clip opening is used for fastening the tie clip to a front opening of a shirt; when a user moves, the tie will have a buffer space provided by the chains.

Another object of the present invention is to provide a tie clip, in which the inner and outer plates form into a clip opening for fastening to a part of a front opening of a shirt, i.e., the tie clip can be moved to any position along a front opening.

Still another object of the present invention is to provide a tie clip, in which both ends of the inner plate are furnished with two small round holes on the upper edges of both ends for connecting two chains made of small metal rings or the like; the other ends of the two chains are sewed to the back side of a tie symmetrically so as to hang the tie clip in a balanced manner.

A further object of the present invention is to provide a tie clip, in which the two chains can provide a buffer space upon a tie making a reverse triangle knot so as to facilitate the tie clip passing through the reverse triangle knot.

DETAILED DESCRIPTION OF THE PREFERRED EMBODIMENT

Figure 1:
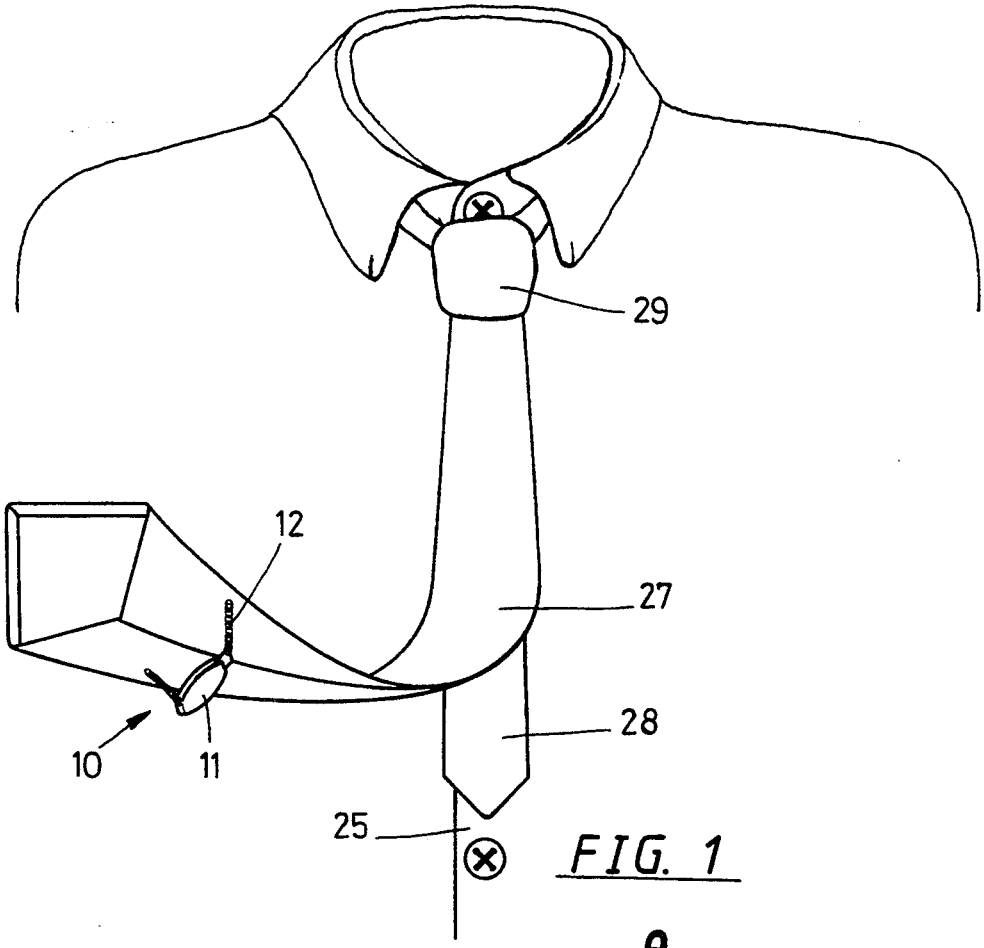
FIG. 1 illustrates the position of a tie clip mounted behind a tie according to the present invention.
Figure 2:
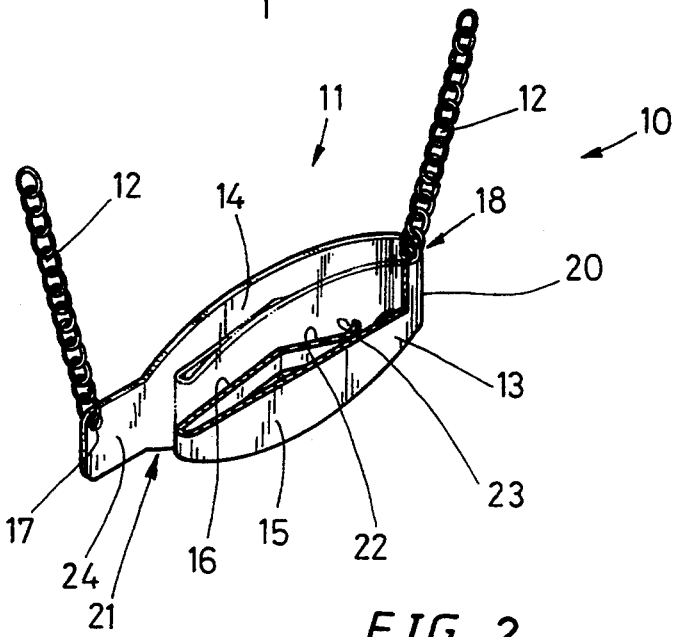
FIG. 2 is a perspective view of an embodiment according to the present invention.
Figure 3:
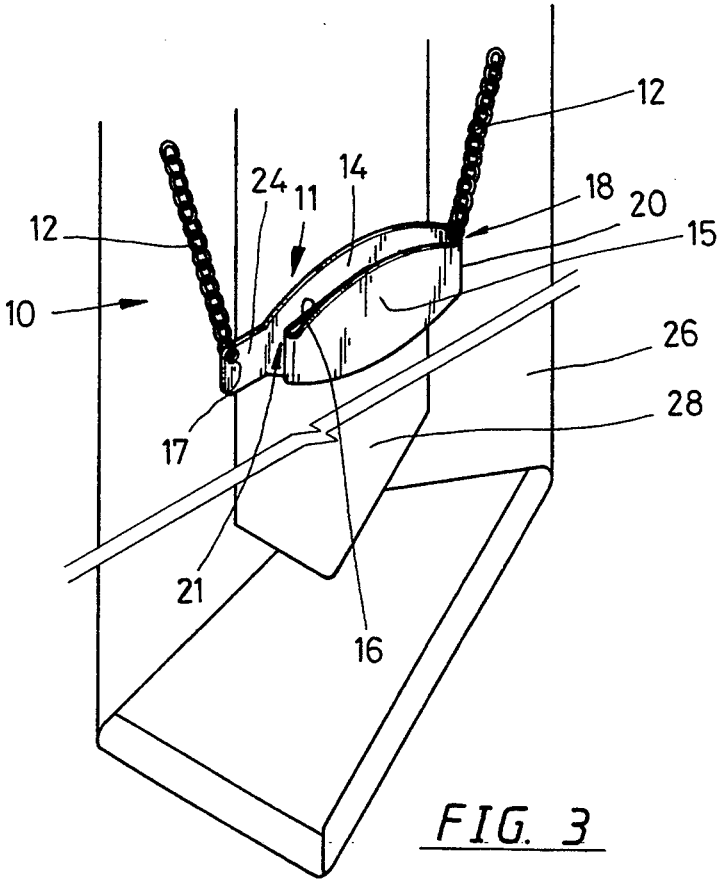
FIG. 3 is a perspective view of the present invention, showing the tie clip mounted behind the back side of a tie.
Figure 4:
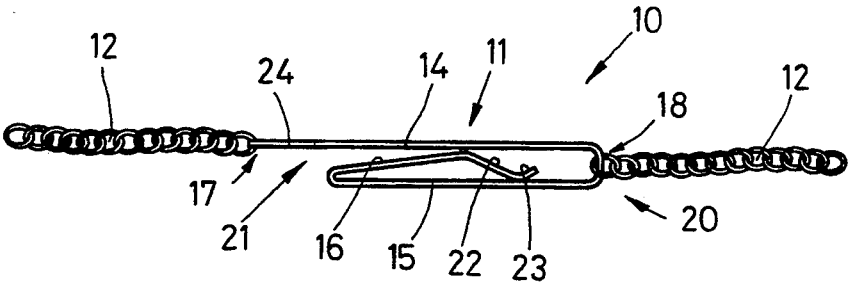
FIG. 4 is a top view of the present invention.

The embodiment of a tie clip 10 is shown in FIGS. 1 to 4; the tie clip 10 comprises a body portion 11 which is formed with a resilient thin plate bent into several folds, and a chain 12 mounted on both sides of the tie clip. The inner plate 14 of the body portion 11 has two symmetrical small round holes 17 and 18 to be connected with two chains 12 respectively; the other ends of the chains 12 are sewed to the back side 26 of a tie symmetrically. The inner plate 14 and the outer plate 15 form a clip opening. The clip opening of the body portion 11 is used to clamp the front opening 25 behind the tie. By means of the buffer effect of the two chains 12, the tie would not become wrinkled or folded because of the tie able to swing with a person's body.

The body portion 11 is made of a resilient thin plate by bending and punching into shape; the body portion 11 includes an inner plate 14, an outer plate 15, an inner clip arm 16, a resilient plate 22 and a hook portion 23; the inner plate 14 and the outer plate 15 are arranged in parallel form, having a bent-closed end 20 at one end, and a clip opening 21 at the other end thereof. Both ends of the inner plate 14 are provided with two small round holes 17 and 18, of which one is furnished on an extended plate 24, and the other is furnished on the upper edge of the bent-closed end 20 so as to connect with the two chains 12 respectively through a small meal ring or the like; the other ends of the two chains 12 are sewed to the back side 26 of a tie separately but symmetrically. Since the small round holes 17 and 18 are furnished on the upper edge of the body portion 11, the body portion 11 will symmetrically be hung on the back side 26 of the tie as a result of the weight thereof.

The clip opening 21 between the inner and outer plates 14 and 15 has an extended plate 24; an inner clip arm 16 is provided within and between the inner and outer plates 14 and 15. The body portion 11 can clamp a front opening 25 of a shirt by means of the extended plate 24; the clip opening 21 has a staircase-shaped opening to guide the body portion 11 to clamp to a front opening.

The inner and outer plates 14 and 15 are arranged in parallel with a bent-closed end 20 and a clip opening 21. The outer plate 15 has an extended and bent part of the inner clip arm 16, which includes a resilient plate 22. The connection point between the inner clip arm 16 and the resilient plate 22 is almost in close contact with the inner surface of the inner plate 14. One end of the resilient plate 22 has a hook portion 23 being almost in close contact with the inner surface of the outer plate 15. The body portion 11 of the tie clip is made of a resilient material; the bent-closed end 20 between the inner and outer plates 14 and 15 can provide a suitable clamp force for the clip opening 21 to attach to a front opening 25; the tie clip can recover its normal shape after being removed from the front opening 25.

The inner clip arm 16 extends from the clip opening 21 into a space between the inner and outer plates 14 and 15. If the body portion 11 is made of different material, it will have a different resilient force; in order to compensate such different resilient force, the outer plate 15 is bent inwards to form an inner clip arm 16, a resilient plate 22 and a hook portion 23; the connection point between the inner clip arm 16 and the resilient plate 22 is in close contact with the inner surface of the inner plate 14.

The body portion 11 is normally hung to the back side 26 of a tie symmetrically as a result of its weight, and two small round holes 17 and 18 on the upper edge of the body portion 11. When a tie is put around the collar of a shirt, and before a reverse triangle knot 29 is made, the body portion 11 would be unable to pass through the loop of the tie because of the body portion 11 having a wide plate; in that case, the body portion 11 can be turned at an angle of 90 degree from a horizontal position to a vertical position to become parallel with the tie 27 because of the body portion 11 able to swing laterally and up-and -down freely by means of the chains 12 attached to both ends thereof. As soon as the reverse triangle knot 29 is made, put the small end 28 of the tie through a space between the body portion 11 and the back side 26 so as to prevent the small end 28 from moving out of back side of the tie 27; then, the clip opening 21 of the body portion 11 can clamp a front opening 25 of a shirt; the tie 27 will be set at a position with the body portion 11 without swinging or flying.

When the tie clip 10 is attached to a front opening 25 of a shirt, the clip opening 21 of the body portion 11 should be set at a level same as that of chains 12 on the back side 26 of the tie. The tie clip 10 put at such a level is to facilitate the tie 27 to have sufficient space to swing as a result of the buffer effect of chains 12 upon a user moving, i.e., the tie 27 and the front opening 25 can always be maintained in a balance and beautiful manner. The tie clip 10 should be clamped to a front opening 25 of a shirt after the reverse triangle knot 29 being made.

In the body portion 11, the inner plate 14 and the outer plate 15 are the same in shape; the outer surface of the outer plate 15 is a flat surface to facilitate the trademark or sign of a manufacturer to attach thereon. The body portion can be designed into an oblong-shaped tie trademark plaque 13, or an elongate or other suitable shapes.

Figure 5:
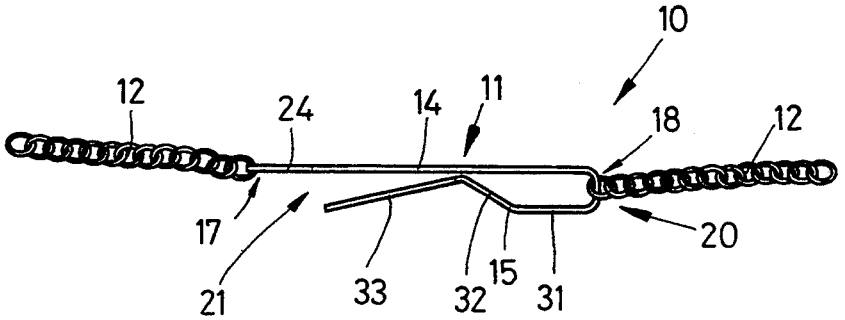
FIG. 5 illustrates a top view of embodiment-2 according to the present invention.

In addition to the embodiment of the body portion 11 as shown in FIGS. 1 to 4, the present invention can also be designed into another embodiment as shown in FIG. 5, in which the body portion 11 comprises an inner plate 14, an outer plate 15, a bent-closed end 20 and a clip opening 21; the outer plate 15 includes a parallel portion 31, a resilient plate 32 and a clip arm 33. The parallel portion 31 is a section extended from the bent-closed end 20, being parallel with the inner plate 14; the other end of the parallel portion 31 has a resilient plate 32 and a longer clip arm 33. The connection point between the resilient plate 32 and the clip arm 33 is in close contact with the inner surface of the inner plate 14. The rear end of the clip arm 33 and the inner plate 14 form a clip opening 21 for clipping to a front opening 25 of a shirt. Both ends of the body portion 11 are furnished with two small round holes 17 and 18 being attached with two chains 12. The other ends of the two chains 12 are sewed to the back side of a tie at a symmetrical position. The clipping point formed with the resilient plate 32 and the clip arm 33 can have a tie clipped to a front opening 25 of a shirt firmly.

According to the aforesaid description for the embodiments, the present invention has provided a practical and unique improvement to the conventional tie clip.

I claim:

1. A tie clip mounted behind a tie comprising:

a body portion being made of a thin and resilient plate bent into a shape; said body portion including an inner plate, an outer plate, an inner clip arm, a resilient plate and a hook portion; a bent-closed end and a clip opening being furnished between said inner plate and said outer plate; said inner plate and said outer plate being arranged in parallel each other, and connected together on said bent-closed end; said outer plate having an inner clip arm between said inner plate and said outer plate; an inner end of said inner clip arm being in close contact with an inner surface of said inner plate; said inner clip arm further extended into said resilient plate and said hook portion; both ends of said inner plate being provided with two small round holes respectively for connecting two chains respectively;

other end of each said chains being sewed to back side of a tie at a symmetrical position to maintain said tie always in a vertical position upon a user movement.

2. A tie clip mounted behind a tie as claimed in claim 1, wherein said two small round holes are provided on upper edge of said inner plate respectively; each said small round hole being fastened to one end of each said chain, while other end of said chain being sewed to back side of a tie at a symmetrical position so as to have said body portion hung behind a tie at a horizontal and balanced position, and to have a tie always set in a vertical, straight and beautiful manner without becoming bent and twisted upon a user moving.

3. A tie clip mounted behind a tie as claimed in claim 1, wherein an inner clip arm is furnished between said inner and outer plates, being extended from said clip opening; said inner clip arm extended further to form into a resilient plate and a hook portion; a connection point between said inner clip arm and said resilient plate being in close contact with an inner surface of said inner plate; a connection point between said resilient plate and said hook portion being in close contact with an inner surface of said outer plate.

4. A tie clip mounted behind a tie as claimed in claim 1, wherein said outer plate bends inwards to form a short resilient plate and a long clip arm; an inner end of said short resilient plate spaced a short distance from an inner surface of said outer plate.

5. A tie clip mounted behind a tie as claimed in claim 1, wherein one end of said inner plate extends out to form an extension plate; said outer plate bent inwards to form an inner clip arm.

6. A tie clip mounted behind a tie comprising:

a body portion including an inner plate and an outer plate, a bent-closed end and a clip opening; said outer plate extended from said bent-closed end to form a short resilient plate and a long clip arm; a connection point between said short resilient plate and said long clip arm being in close contact with an inner surface of said inner plate; said long clip arm and said inner plate forming a clip opening; both ends of said inner plate being furnished with two small holes respectively for attaching two ends of two chains respectively;

said two chains each being made of a plurality of small rings; said two chains being connected with said two small round holes respectively at one end thereof, while other ends of said chains being sewed to back side of a tie in symmetrical position to have said tie always in a vertical and straight manner without becoming bent and twisted upon a user movement.

* * * * *